US009279243B2

(12) United States Patent
Caboni

(10) Patent No.: US 9,279,243 B2
(45) Date of Patent: Mar. 8, 2016

(54) MODULAR CONSTRUCTION SYSTEM FOR REINFORCING FOUNDATION, PILLARS, ISOLATED FOOTINGS AND ANTI-SEISMIC SEPARATORS, INTENDED FOR VARIABLE-GEOMETRY HEAT-INSULATION FORMWORK

(76) Inventor: Michele Caboni, Oristano (IT)

( * ) Notice: Subject to any disclaimer, the term of this patent is extended or adjusted under 35 U.S.C. 154(b) by 0 days.

(21) Appl. No.: 13/979,574

(22) PCT Filed: Jan. 10, 2012

(86) PCT No.: PCT/IT2012/000007

§ 371 (c)(1),
(2), (4) Date: Jul. 12, 2013

(87) PCT Pub. No.: WO2012/095883

PCT Pub. Date: Jul. 19, 2012

(65) Prior Publication Data

US 2013/0283714 A1 Oct. 31, 2013

(30) Foreign Application Priority Data

Jan. 13, 2011 (IT) ..... TO2011A0016

(51) Int. Cl.

| | |
|---|---|
| ***E04B 1/16*** | (2006.01) |
| ***E04B 1/20*** | (2006.01) |
| ***E04B 5/18*** | (2006.01) |
| ***E02D 27/34*** | (2006.01) |
| ***E04C 3/34*** | (2006.01) |
| ***E04C 5/16*** | (2006.01) |
| ***E04C 5/20*** | (2006.01) |
| ***E04B 1/30*** | (2006.01) |

(52) U.S. Cl.
CPC ..... *E04B 1/167* (2013.01); *E02D 27/34* (2013.01); *E04B 1/30* (2013.01); *E04C 3/34* (2013.01); *E04C 5/168* (2013.01); *E04C 5/208* (2013.01)

(58) Field of Classification Search
CPC ..... E04B 1/678; E04B 1/20; E04B 1/21
USPC ..... 52/319, 340, 341, 334, 561, 573.1
See application file for complete search history.

(56) References Cited

U.S. PATENT DOCUMENTS 3,151,391 A 10/1964 Ollier
3,335,262 A * 8/1967 Smart et al. ..... 219/474

(Continued)

FOREIGN PATENT DOCUMENTS

CA 2264099 2/1998
CH 367966 3/1963

(Continued)

OTHER PUBLICATIONS

International Search Report for PCT/IT2012/000007, Completed by the European Patent Office on Jun. 25, 2012, 3 Pages.

*Primary Examiner* — Mark Wendell
*Assistant Examiner* — Keith Minter

(57) ABSTRACT

A modular construction system used for reinforcing all shapes of foundation, pillars, isolated footings and anti-seismic separators intended for transpiring, heat-insulation variable-geometry formwork, including at least one guide plane for the vertical elements of such reinforcement and at least one supporting bracket for such plane, said bracket being suited to make it possible to install such guide plane relative to such transpiring, "disposable" heat-insulation formwork.

14 Claims, 19 Drawing Sheets

(56) References Cited

U.S. PATENT DOCUMENTS

| | | | | |
|---|---|---|---|---|
| 3,728,835 | A * | 4/1973 | McManus | 52/334 |
| 4,136,798 | A | 1/1979 | Oberstein | |
| 4,472,331 | A | 9/1984 | Kida | |
| 4,546,580 | A * | 10/1985 | Ueno et al. | 52/126.1 |
| 4,731,968 | A | 3/1988 | Obino | |
| 4,833,857 | A | 5/1989 | Wheeler | |
| 5,383,319 | A | 1/1995 | Sorqvist | |
| 5,428,933 | A | 7/1995 | Philippe | |
| 5,499,476 | A * | 3/1996 | Adams et al. | 52/220.1 |
| 5,687,530 | A * | 11/1997 | Van der Heijden | 52/592.6 |
| 5,788,152 | A * | 8/1998 | Alsberg | 237/69 |
| 6,170,202 | B1 * | 1/2001 | Davoodi et al. | 52/167.1 |
| 6,370,831 | B1 | 4/2002 | Marshall et al. | |
| 6,451,400 | B1 * | 9/2002 | Brock et al. | 428/44 |
| 6,467,224 | B1 * | 10/2002 | Bertolini | 52/177 |
| 7,082,732 | B2 | 8/2006 | Titishov | |
| 7,587,865 | B2 * | 9/2009 | Moller, Jr. | 52/181 |
| 8,020,783 | B2 * | 9/2011 | Backman, Jr. | 237/69 |
| 8,181,414 | B2 | 5/2012 | Garrett | |
| 8,429,860 | B2 * | 4/2013 | Kugler et al. | 52/126.6 |
| 2003/0061772 | A1 * | 4/2003 | Bertolini | 52/98 |
| 2003/0089051 | A1 * | 5/2003 | Bertolini | 52/177 |
| 2004/0103609 | A1 | 6/2004 | Wostal et al. | |
| 2005/0028466 | A1 | 2/2005 | Titishov | |
| 2005/0252109 | A1 * | 11/2005 | Fuccella et al. | 52/177 |
| 2006/0070314 | A1 * | 4/2006 | Jenkins et al. | 52/177 |
| 2007/0214740 | A1 | 9/2007 | O'Grady | |
| 2008/0172972 | A1 | 7/2008 | Williams | |
| 2009/0026192 | A1 * | 1/2009 | Fuhrman | 219/523 |
| 2009/0044481 | A1 | 2/2009 | Turek | |
| 2010/0065716 | A1 | 3/2010 | Amend | |
| 2010/0107541 | A1 * | 5/2010 | Bohnhoff | 52/561 |

FOREIGN PATENT DOCUMENTS

| | | |
|---|---|---|
| DE | 2013630 | 11/1971 |
| DE | 3410484 | 10/1985 |
| DE | 9418036 | 1/1995 |
| DE | 4332115 | 3/1995 |
| DE | 29611835 | 11/1996 |
| DE | 102008050741 | 4/2010 |
| EP | 0137105 | 4/1985 |
| EP | 0163117 | 12/1985 |
| EP | 0368804 | 5/1990 |
| EP | 0803618 | 10/1997 |
| EP | 1092816 | 4/2001 |
| EP | 1605113 | 12/2005 |
| FR | 663193 | 8/1929 |
| FR | 2328814 | 5/1977 |
| FR | 2813903 | 3/2002 |
| FR | 2874950 | 3/2006 |
| JP | 2002348858 | 12/2002 |
| WO | 9119055 | 12/1991 |
| WO | 03046310 | 6/2003 |
| WO | 2005014948 | 2/2005 |
| WO | 2005035898 | 4/2005 |
| WO | 2005061804 | 7/2005 |
| WO | 2006063140 | 6/2006 |
| WO | 2006081678 | 8/2006 |
| WO | 2008098686 | 8/2008 |

* cited by examiner

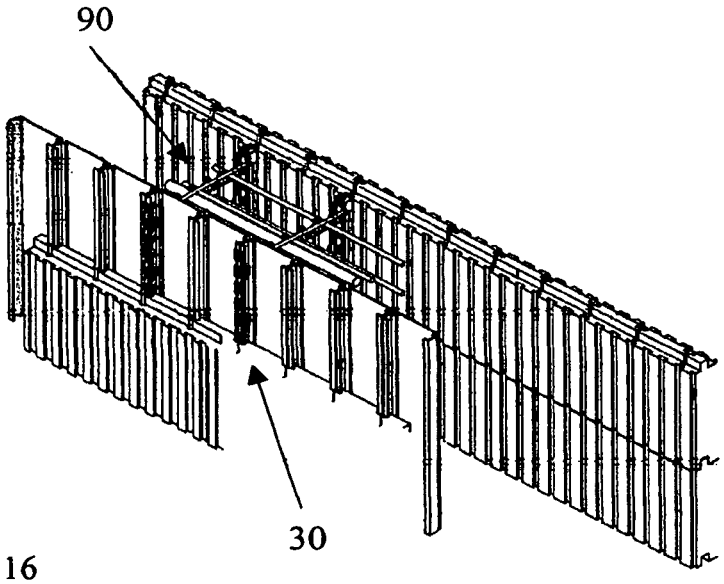
FIG. 16
FIG. 17
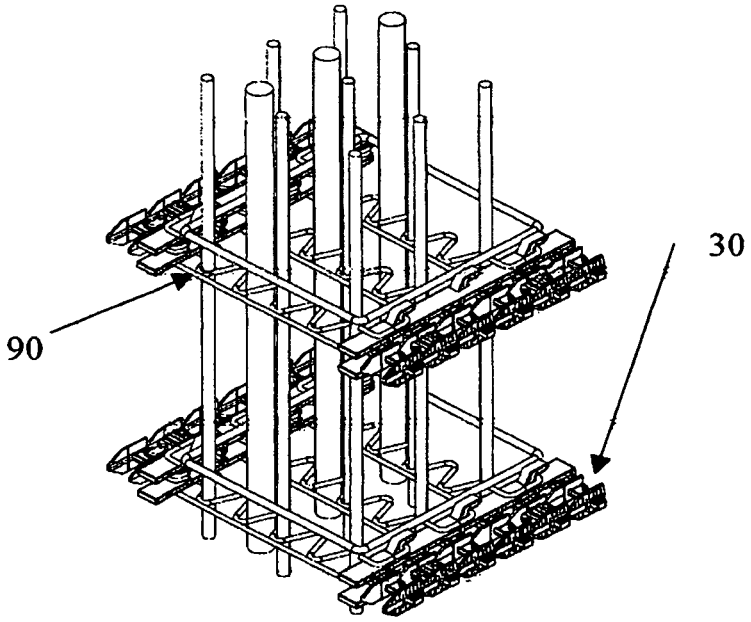

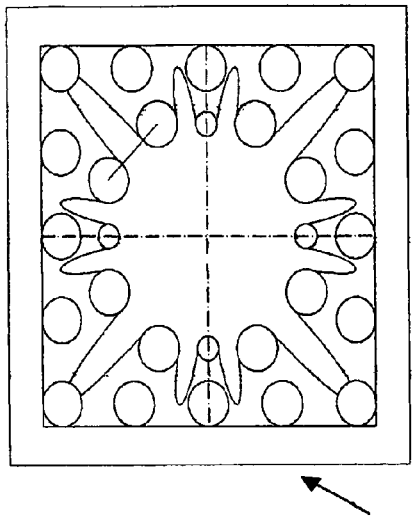
FIG. 21
FIG. 22
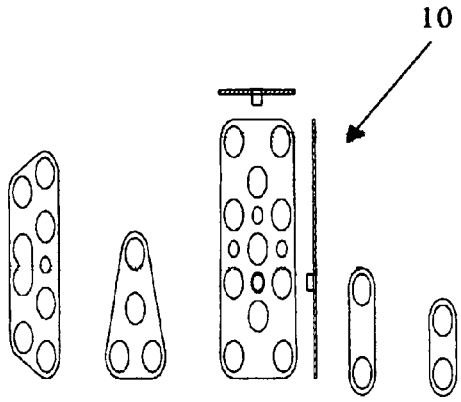
FIG. 23
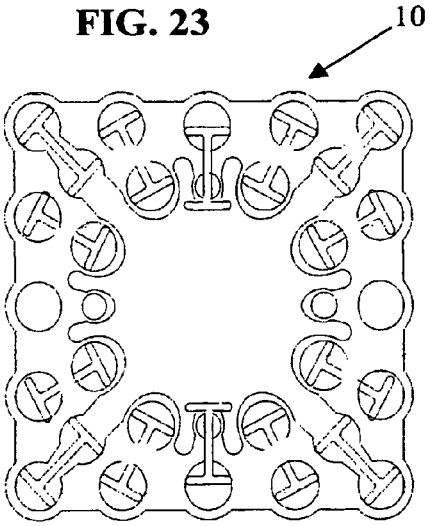
FIG. 24
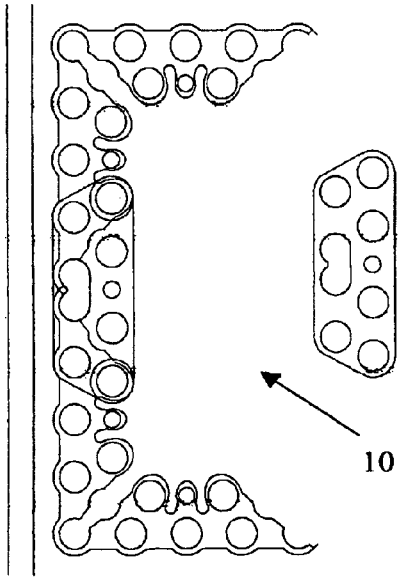

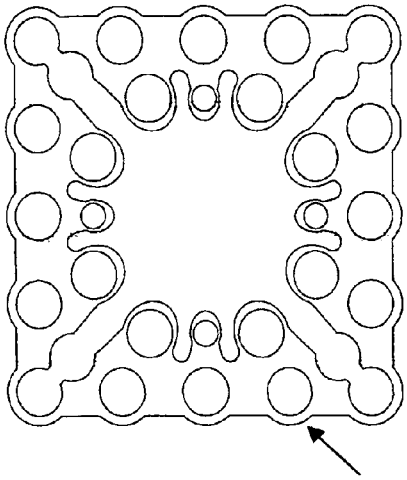
FIG. 25
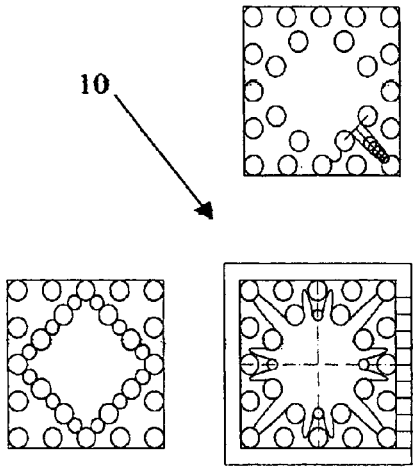
FIG. 26
FIG. 27
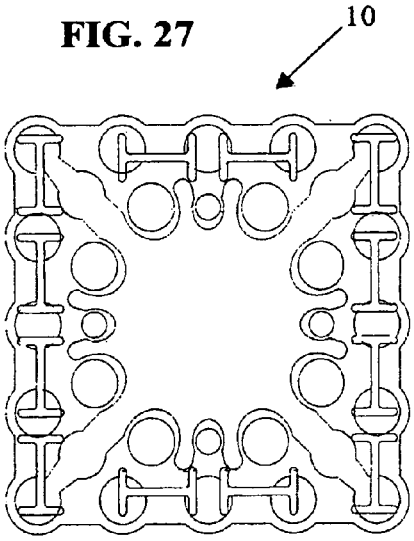
FIG. 28
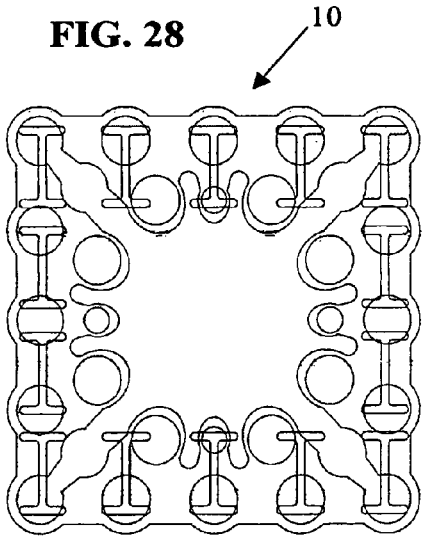

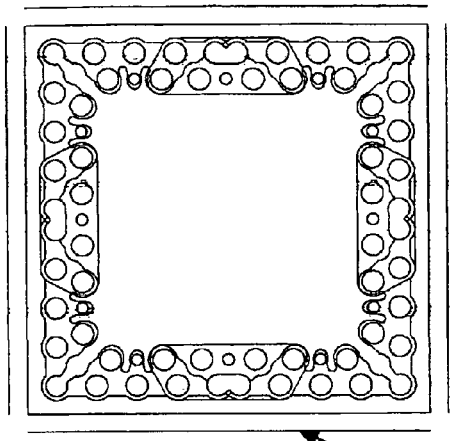
FIG. 29
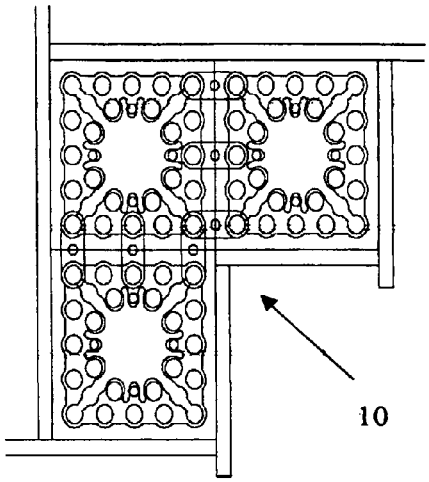
FIG. 30
FIG. 31
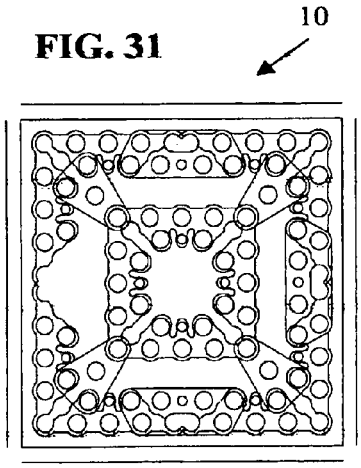
FIG. 32
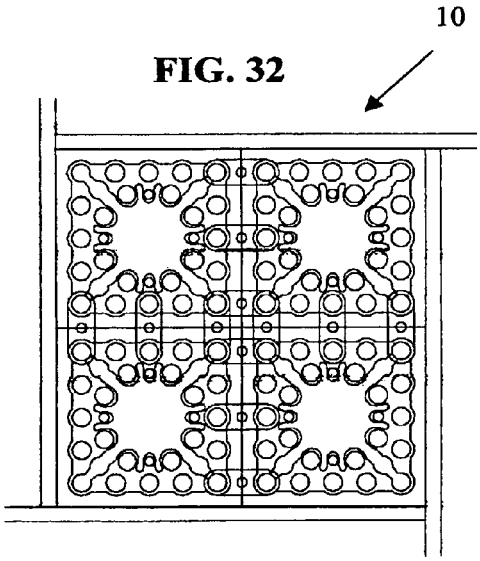

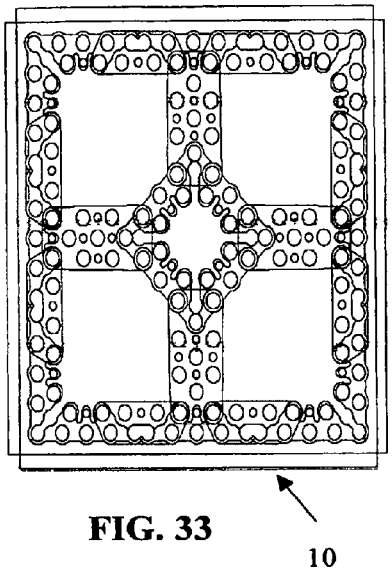
FIG. 33
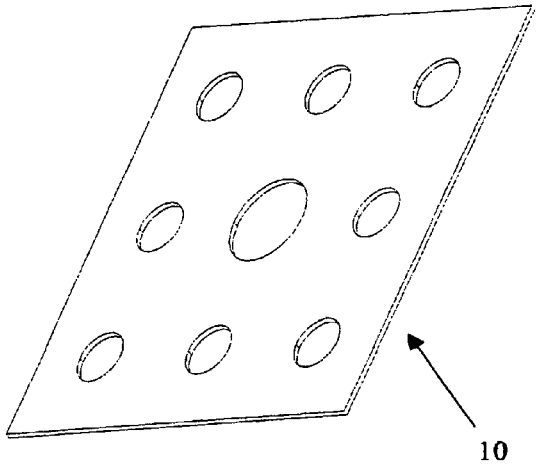
FIG. 34
FIG. 35
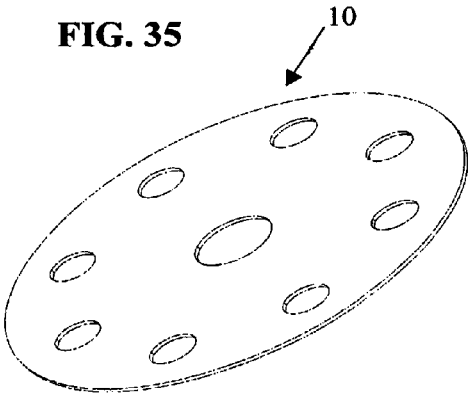
FIG. 36
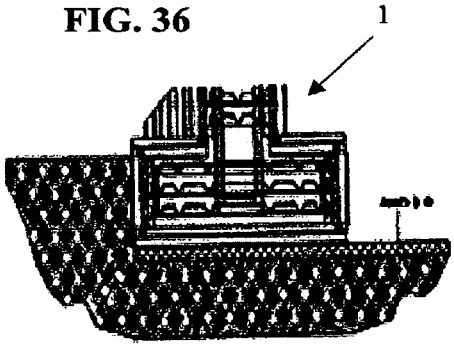

MODULAR CONSTRUCTION SYSTEM FOR REINFORCING FOUNDATION, PILLARS, ISOLATED FOOTINGS AND ANTI-SEISMIC SEPARATORS, INTENDED FOR VARIABLE-GEOMETRY HEAT-INSULATION FORMWORK

CROSS-REFERENCE TO RELATED APPLICATION

This application is the U.S. national phase of PCT Application No. PCT/IT2012/000007 filed on Jan. 10, 2012, which claims priority to Italian Patent Application No. TO2011A000016 filed on Jan. 13, 2011, the disclosures of which are incorporated in their entirety by reference herein.

This invention pertains to a modular construction system used for reinforcing all shapes of foundation, pillars, isolated footings, anti-seismic separators for variable-geometry formwork.

Notedly, a formwork is a structure used in the building and construction trade to build the reinforced concrete works. It provides a casing into which the additional concrete in the liquid state is cast, after the reinforcement irons have been properly positioned and tied together with their attached structural brackets, where the concrete stays until the completion of the setting process and after the cast has, once the hardening phase has started, achieved such mechanical strength as to guarantee the absorption of the stress which the structure has to withstand soon after the conventional formwork itself has been taken apart.

Formworks can be made of several materials; in particular, "disposable" formworks are currently available for building and construction purposes (in particular, used for building uni-directional lofts and masonry), which are made up of blocks featuring hollows and of polystyrene foam panels made by means of the technique generally referred to as Insulated Concrete Form (ICF), as well as of their respective spacing connectors, which are co-stamped disposable items needed for the assembling and internal blocking of the various aforesaid panels making up the shuttering mould of a reinforced concrete wall.

Though the connectors currently employed simply, to a significant extent, the assembling of "disposable" (though static) formworks, for positioning the pillar reinforcement irons (the latter being typically in the form of steel rods), conventional methods are still applied, which entail the longitudinal and vertical positioning of reinforcement rods essentially in accordance with two methods:

- irons are inserted individually and are, then, kept in the desired position by being tied to a plurality of brackets making up the horizontal falsework (usually made of rods folded in a quadrangular fashion) arranged along the reinforcement irons: such an obsolete system obviously require a longer setting time, as well as skilled labour;
- the reinforcement consists of falsework previously welded or tied by means of annealed iron wire, which incorporate both the oblong vertical irons and the horizontal constraint structures: in this case, carrying such falsework is quite expensive, since the falsework are quite bulky compared to its weight and dimensions (both as regards the width and the length).

Thus, the aim of this invention is to solve the above-mentioned problems relative to the older method, by providing a unique, dynamic modular construction system to be used for simple, quick application of the foundation reinforcements, pillars, isolated footings, anti-seismic separators for transpiring, "disposable", heat-insulation and variable-geometry formworks, which will make it possible to easily, conveniently and quickly fit the reinforcement irons for such pillars, regardless of the relevant section and shape.

One further aim of this invention is to provide a dynamic modular construction system for reinforcing any one shape of foundation, pillars, isolated footings, anti-seismic separators for transpiring, "disposable", heat-insulation and variable-geometry formwork, made up of modular elements easy to be placed into position in accordance with the most varied design requirements, such modular elements being able to be carried easily due to their being lightweight, modular and able to be overlapped one another while taking up very small volumes, the latter peculiarity being advantageous to ensure both environment protection and practical application in building sites situated in broken ground areas, indeed by giving obvious construction advantages especially in downtown districts, where the spaces are taken up by dwellers.

Furthermore, one aim of this invention is to provide a dynamic modular construction system for assembling the reinforcement for a large number of foundation, pillars, isolated footings, anti-seismic separators for transpiring, "disposable", heat-insulation and variable-geometry formwork, which consists of elements able to be easily positioned in accordance with the most varied structural design requirements and also easily assembled by constant measuring pitches, to guarantee homogeneous strength, indeed also in order to guarantee safety and the building site.

The above and the other aims and advantages of the invention, as detailed in the description hereafter, will be obtained by making use of a dynamic modular construction system used for reinforcing foundation, pillars, isolated footings, anti-seismic separators for transpiring, "disposable", heat-insulation and variable-geometry formwork, like the one described in accordance with claim 1. Preferred embodiment designs and original variants of this invention will be the object of the relevant claims.

It is obvious that a number of variants and modifications can be made to the described items (e.g. variants and modifications concerning the coupling of several insulating panels with the respective variable-pitch reinforcement, as well as concerning the shape dimensions, arrangements and the parts performing equivalent functions) without departing from the scope of protection of the invention, as referred to in the enclosed claims.

This invention will be best described by a few preferred embodiments, which will be provided by way of example and with no limitation thereto, with reference to the enclosed drawings, where:

Figure 3:
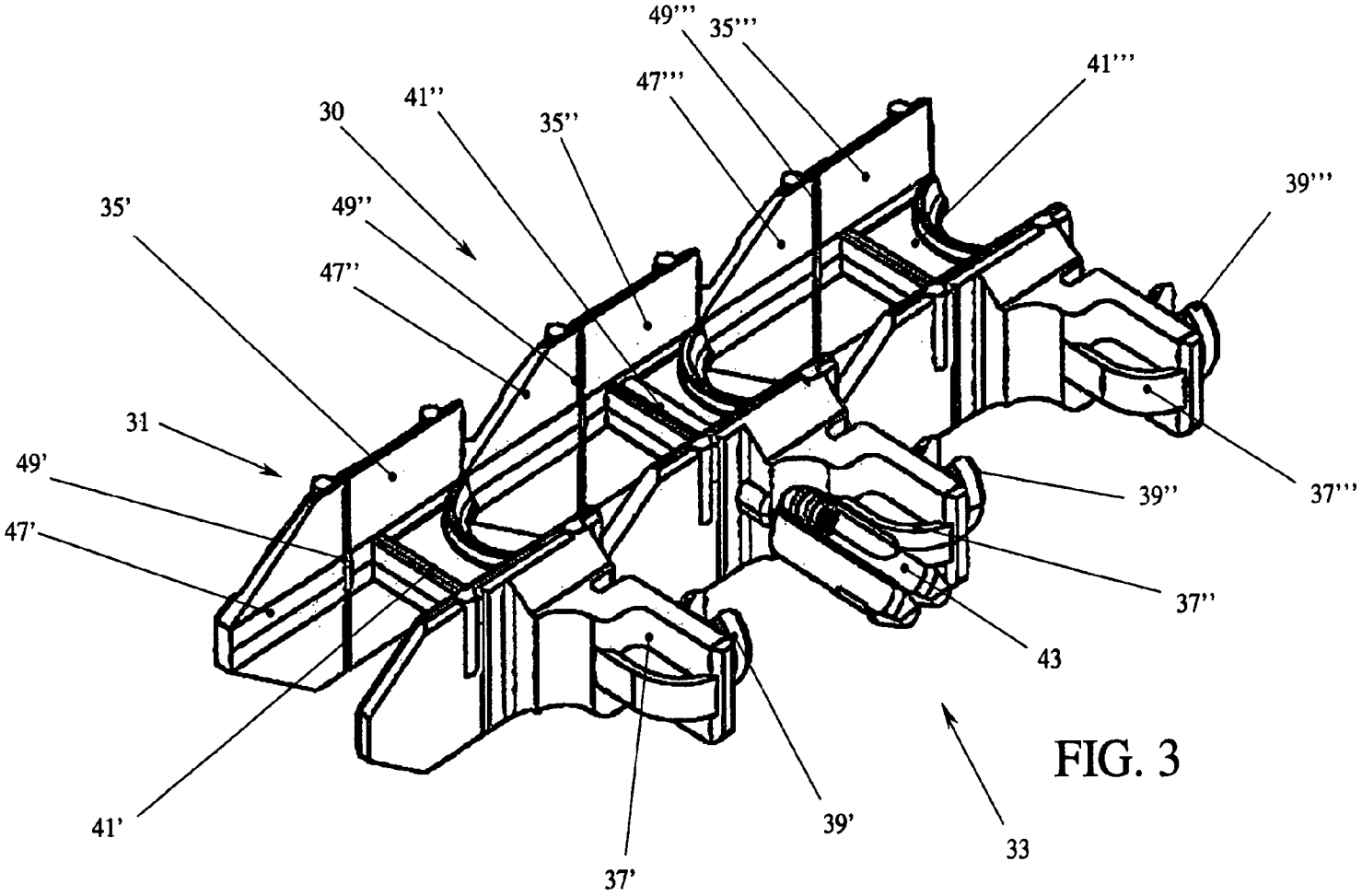
Figure 5:
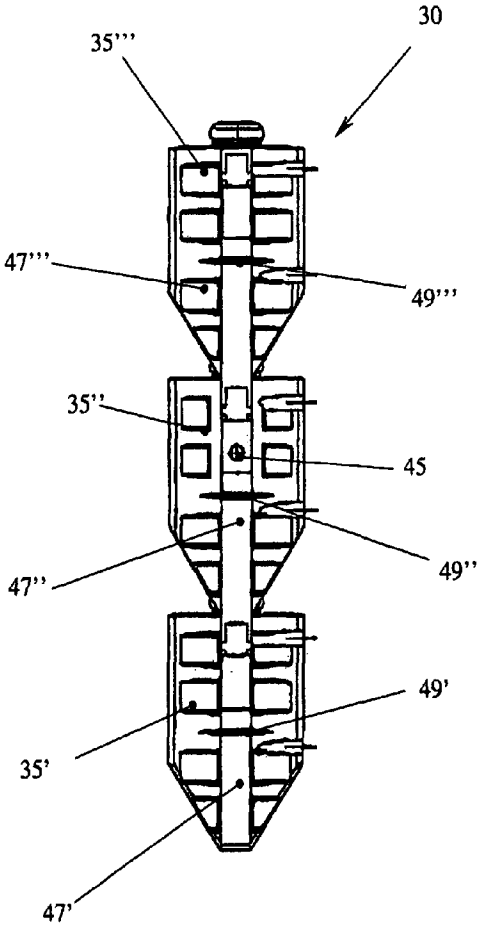
Figure 4:
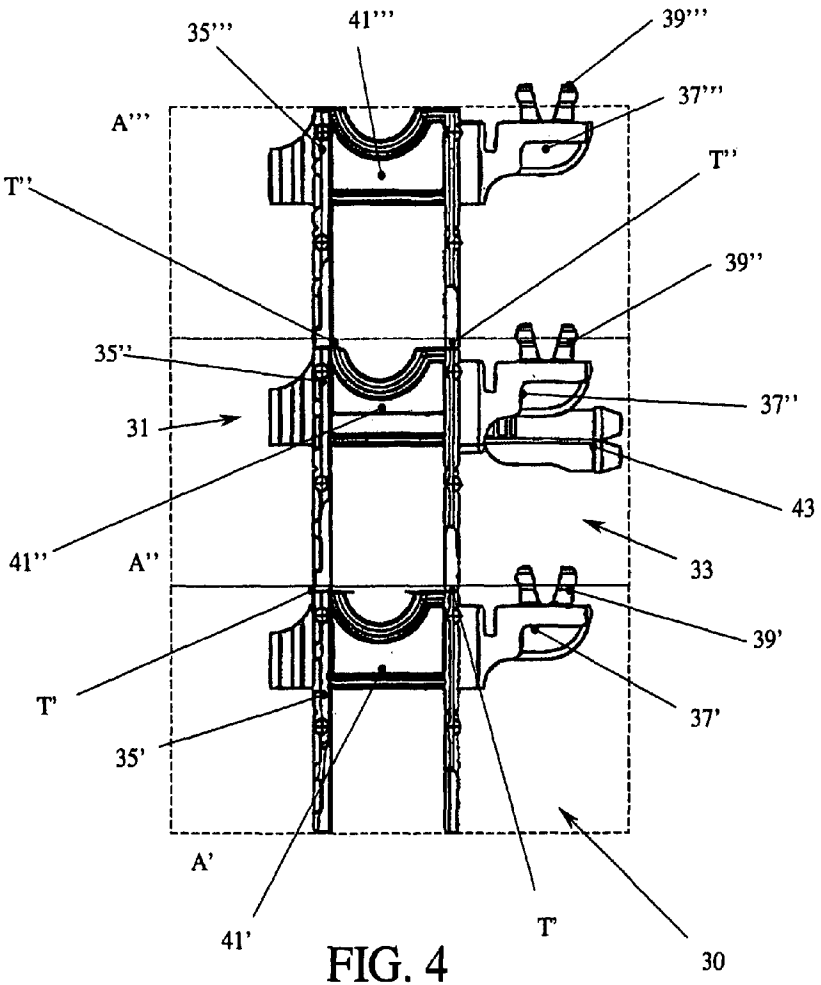
Figure 6:
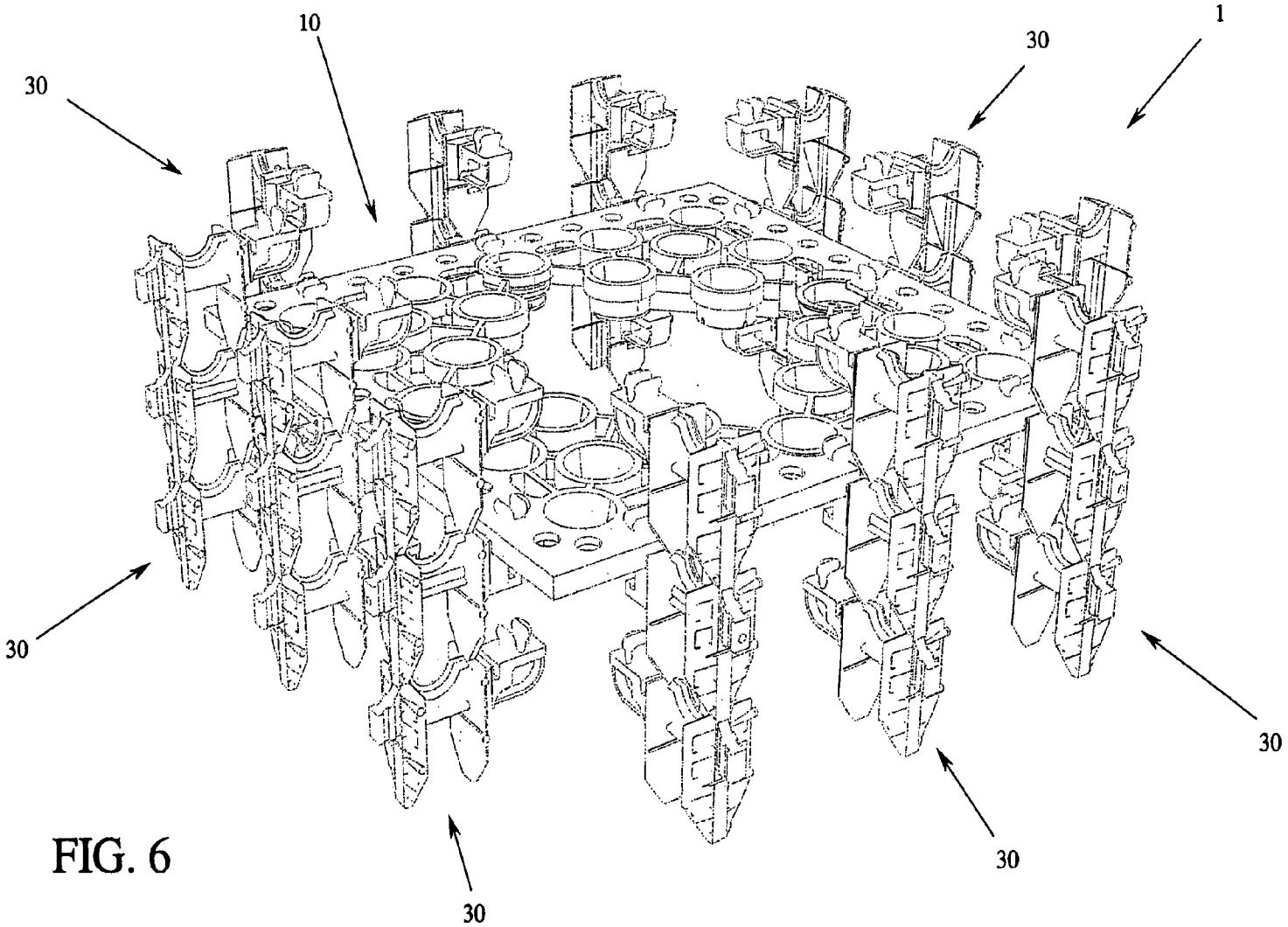
Figure 7:
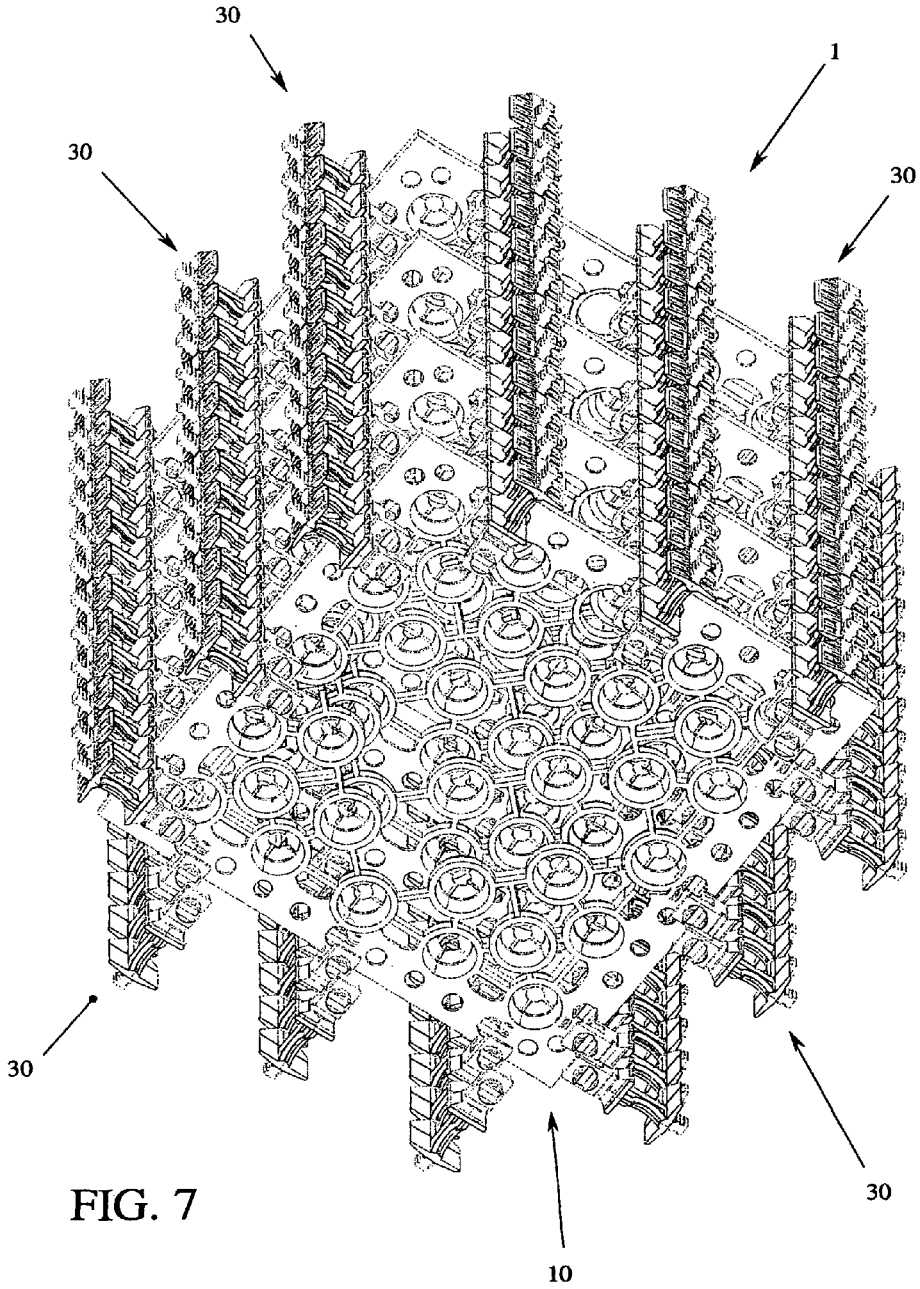
Figure 8:
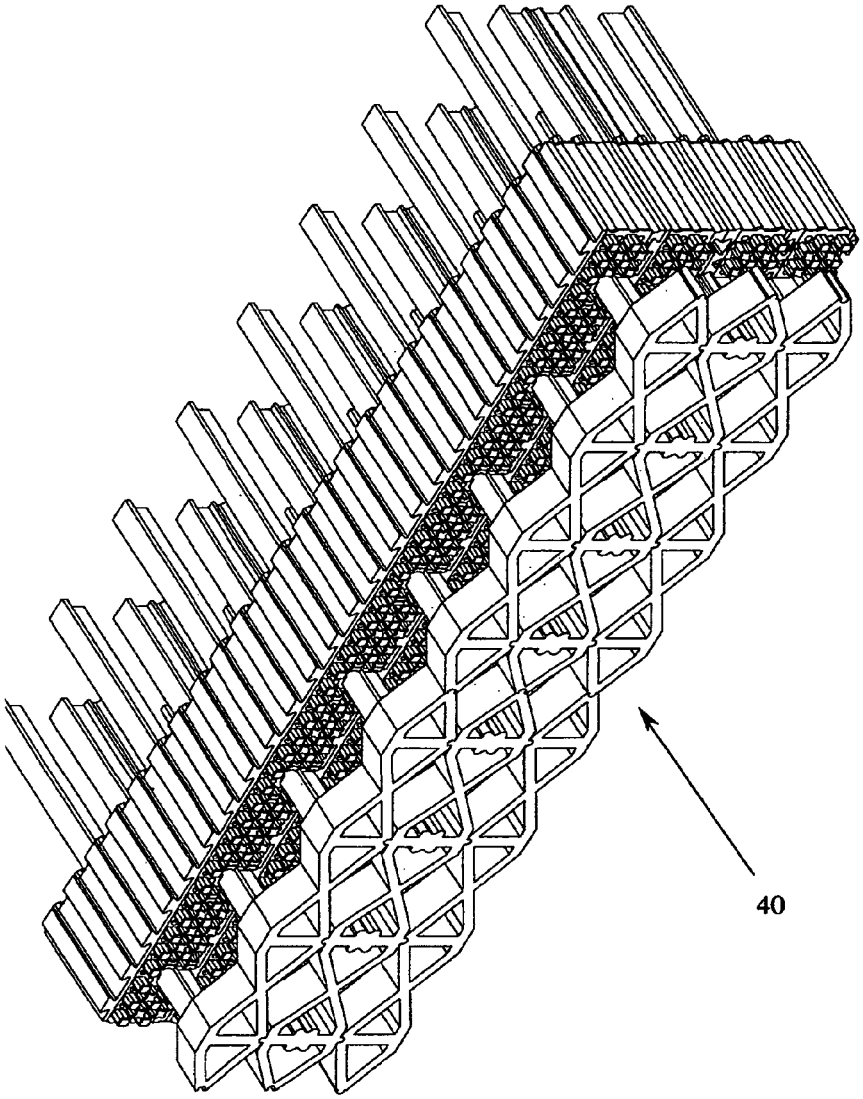
Figure 10:
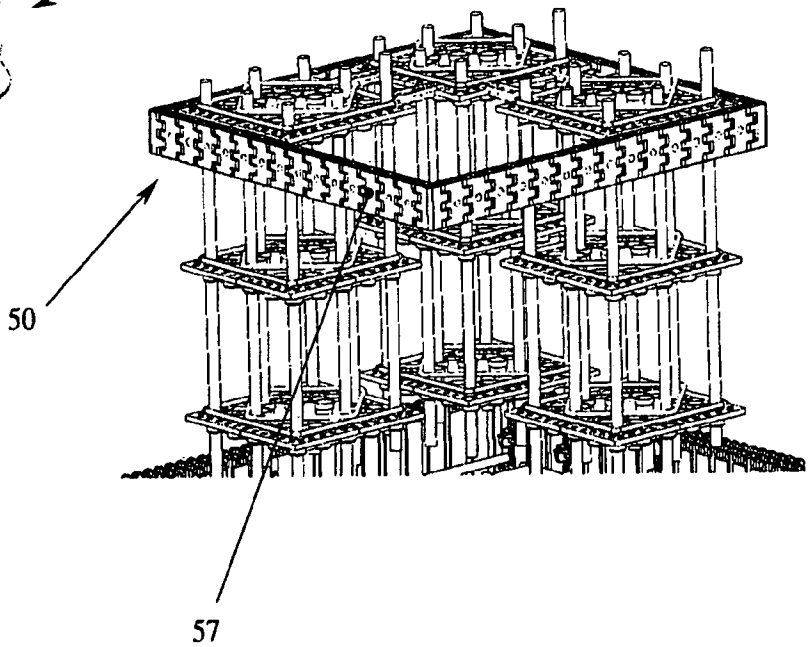
Figure 9:
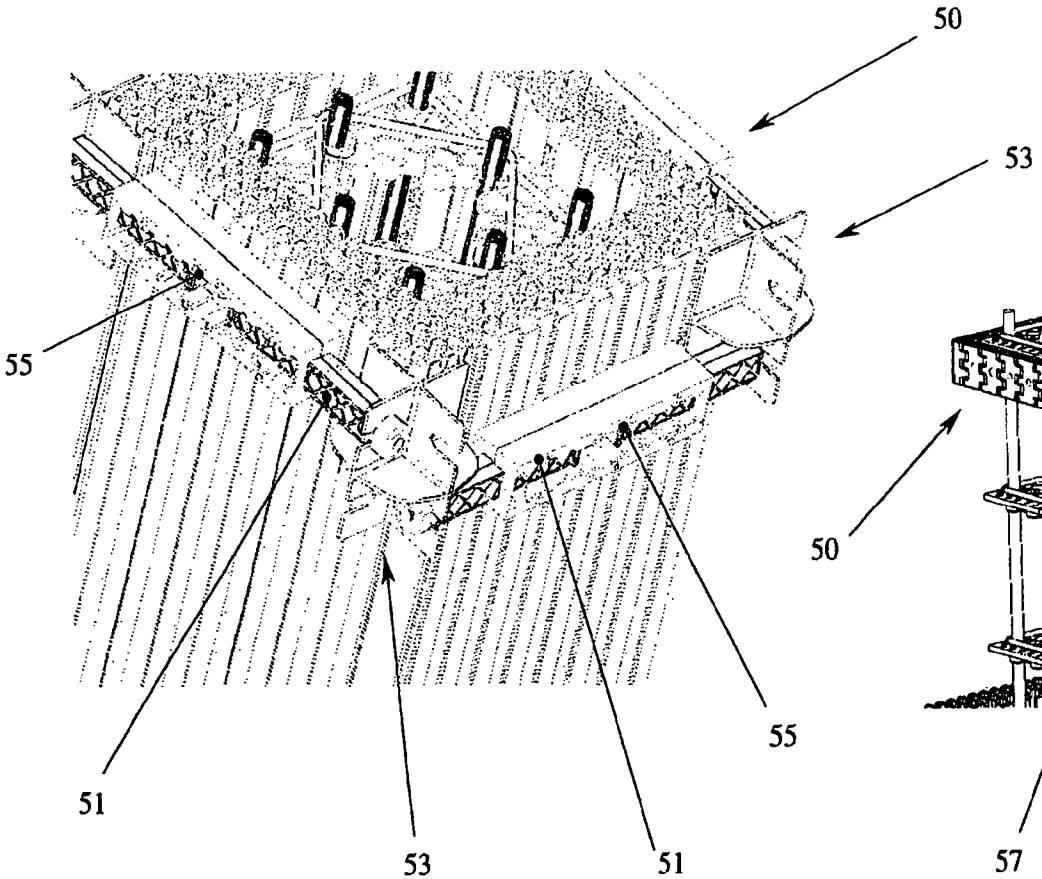
Figure 11:
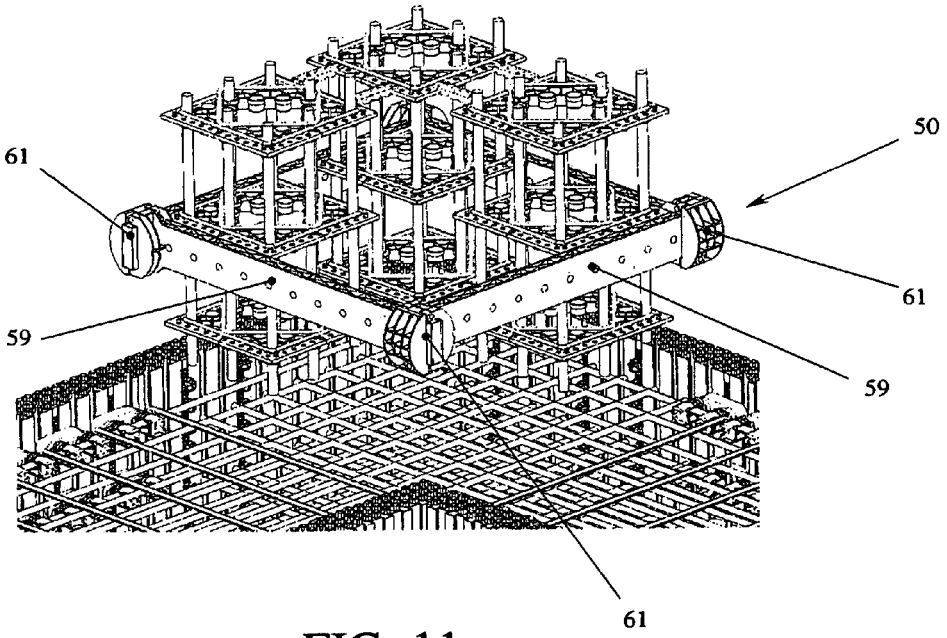
Figure 12:
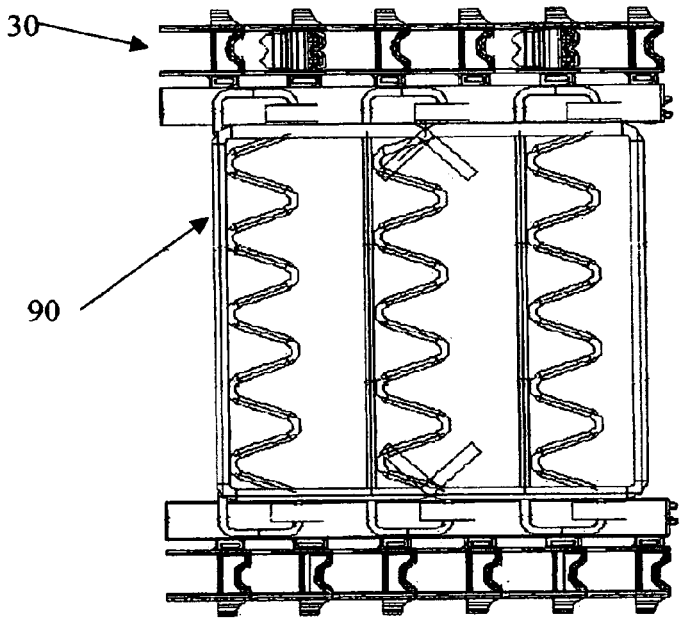
Figure 13:
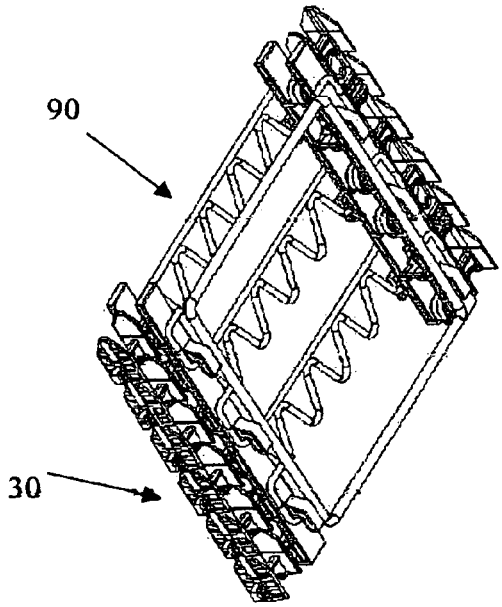
Figure 14:
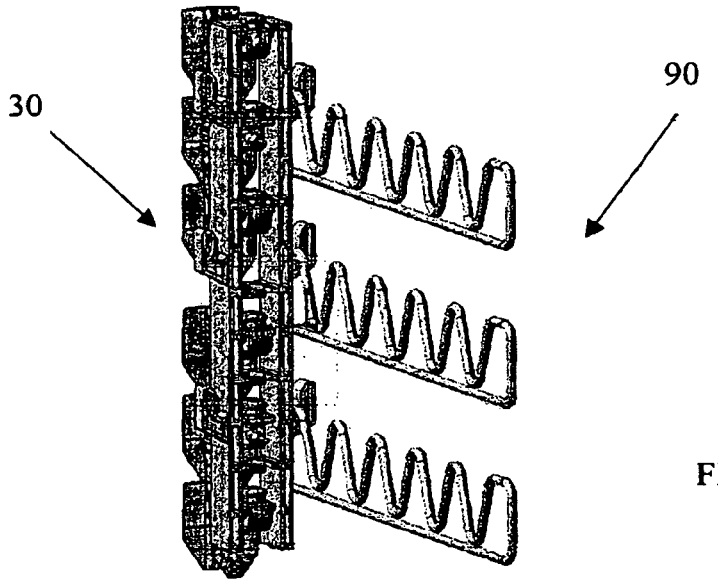
Figure 15:
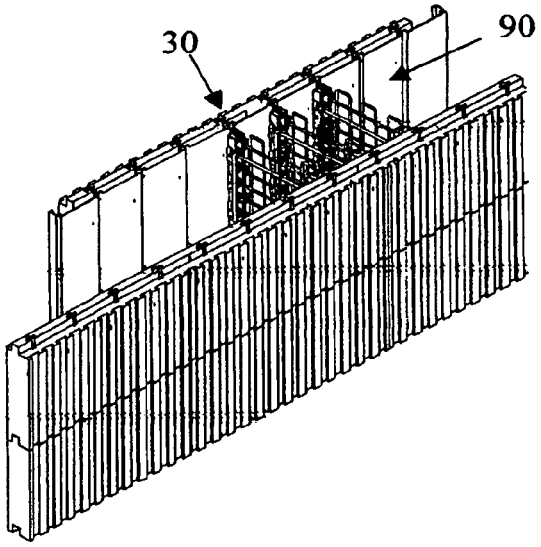
Figure 18:
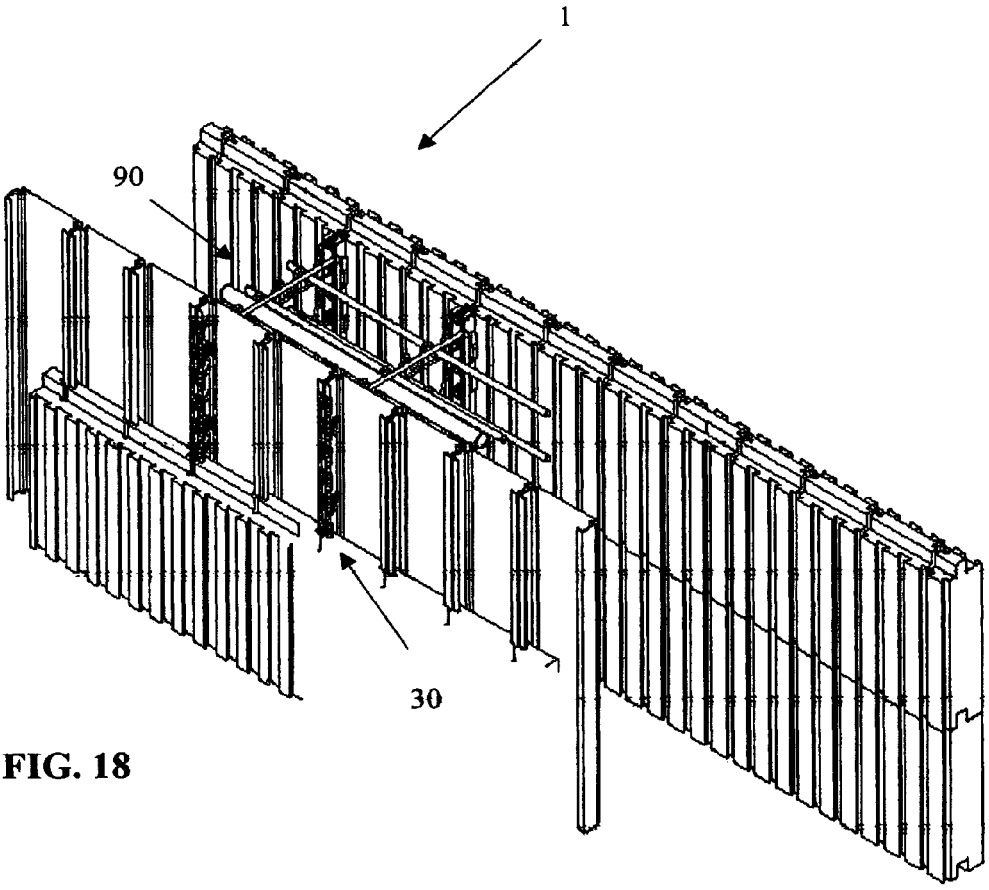
Figure 19:
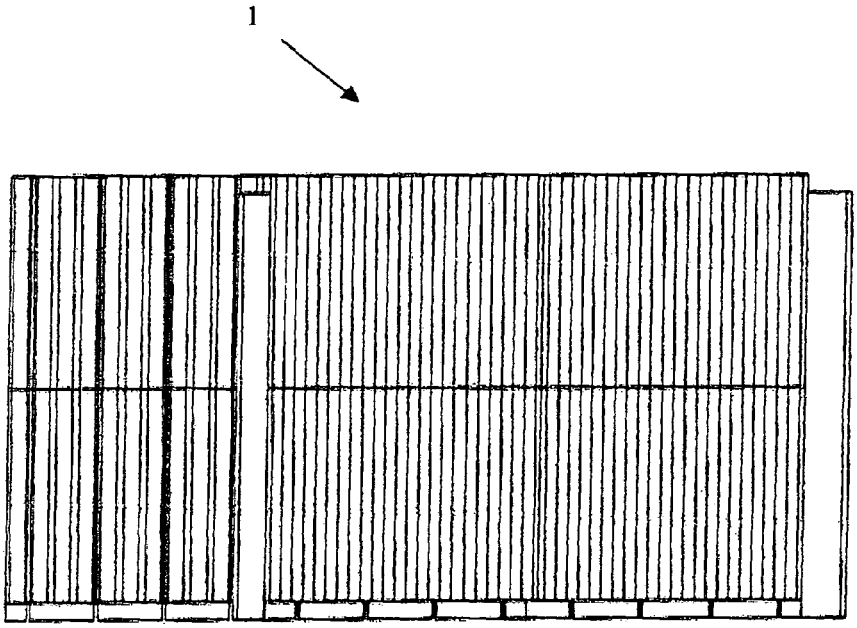
Figure 20:
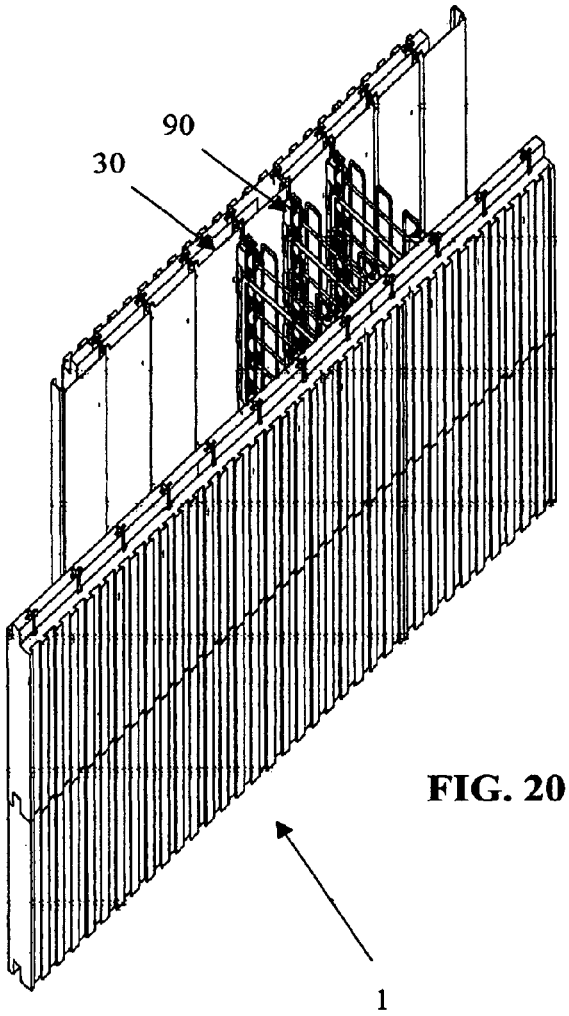

FIG. 3 shows a perspective top view relative to a preferred embodiment of another element and/or connector making up the dynamic modular construction system used for reinforcing the various types of foundation, pillars, isolated footings, anti-seismic separators intended for transpiring, "disposable", heat-insulation and variable-geometry formwork in accordance with the present invention; and FIG. 4 shows a front view of the multi-function connecting element shown in FIG. 3;

FIG. 5 shows a side view of the multi-function connecting element shown in FIG. 3;

FIG. 6 shows a perspective top view of the multi-function connecting elements relative to the system in accordance with the present invention, as assembled and/or associated according to one possible installation configuration;

FIG. 7 shows a perspective bottom view of the connecting elements relative to the dynamic construction system in accordance with the present invention, as assembled and/or associated according to one further possible installation configuration;

FIG. 8 shows a perspective bottom view of a preferred embodiment relative to another grid element for a base integrally constraining the vertical reinforcement making up the dynamic modular construction system used for reinforcing the various types of foundation, pillars, isolated footings, anti-seismic separators intended for variable-geometry formwork, in accordance with the present invention;

FIGS. 9, 10 and 11 show perspective top views of a few preferred embodiments of an enclosing system making up the dynamic modular construction system used for reinforcing the various types of foundation, pillars, isolated footings, anti-seismic separators intended for variable-geometry formwork in accordance with the present invention; and FIGS. 12 to 15 show perspective and side views of the modular construction system and the supporting brackets referred to in the present invention.

By referring to the Figures, you can notice that the dynamic modular construction system 1 used for reinforcing the various types of foundation, pillars, isolated footings, anti-seismic separators (even featuring complex shapes and lying in sloping, vertical or horizontal positions) intended for transpiring, "disposable", heat-insulation and variable-geometry formwork, includes at least one guide plane 10 for the vertical elements (which will be referred to, for the sake of concision, as "irons" hereafter) making up such reinforcement, and at least one supporting bracket 30 for such plane 10, such bracket 30 being suited to make it possible to install the guide plane 10 relative to a transpiring, "disposable" heat-insulation formwork (not shown) and, in particular, a formwork made of EPS polystyrene foam panels in accordance with the Insulated Concrete Form (ICF) method.

Figure 1:
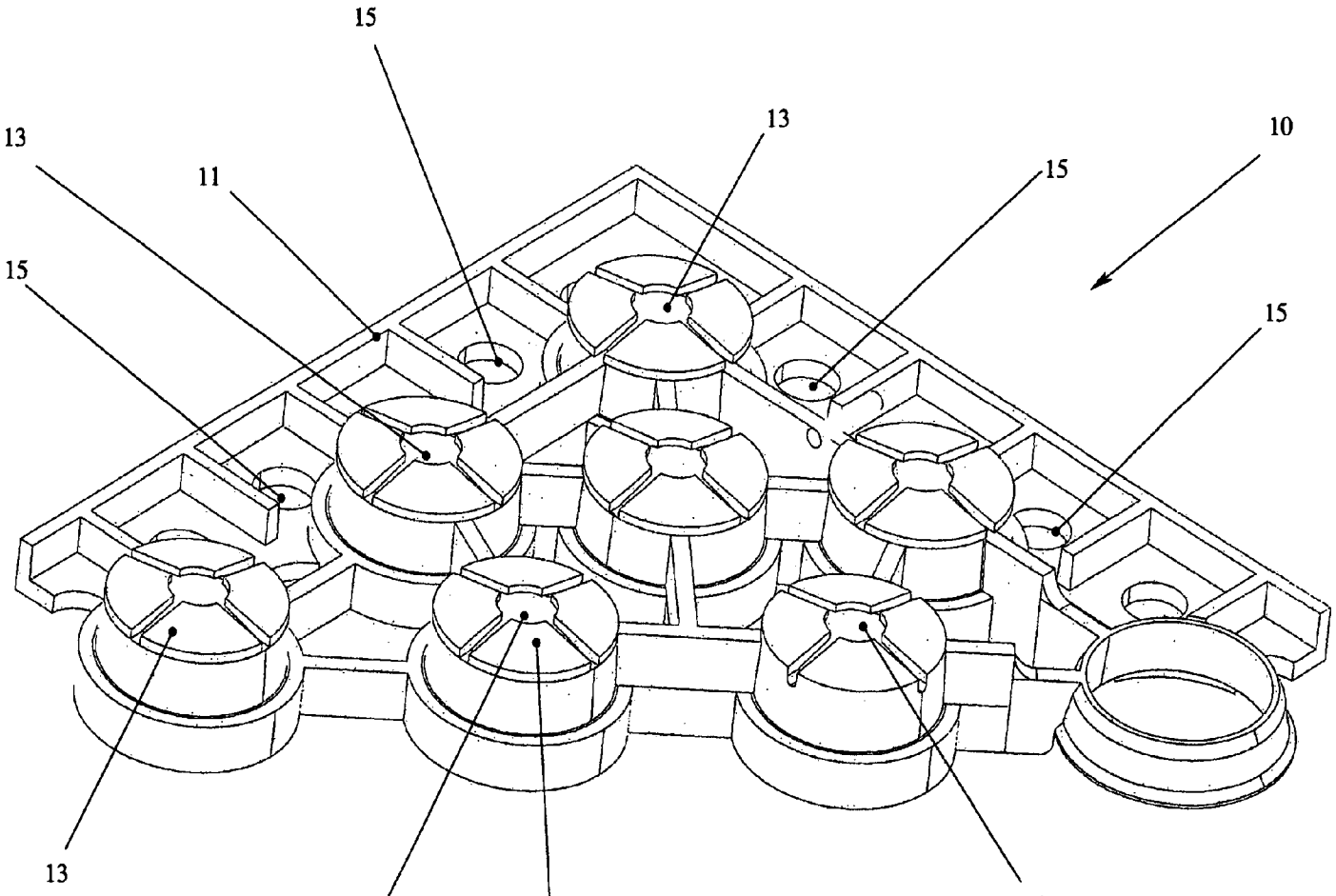
FIG. 1 shows a perspective top view relative to a preferred embodiment of an element making up the dynamic modular construction system used for reinforcing the several types of foundation, pillars, isolated footings, anti-seismic separators intended for transpiring, "disposable", heat-insulation and variable-geometry formwork in accordance with the present invention.
Figure 2:
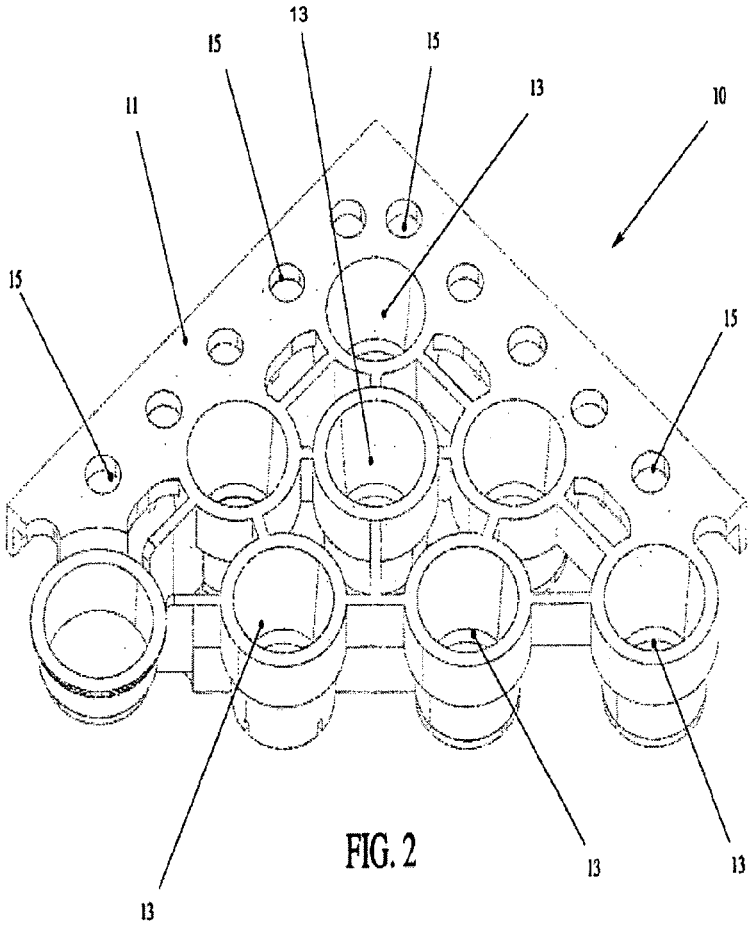
FIG. 2 shows a perspective top view of the element shown in FIG. 1.

By referring to FIGS. 1 and 2 in particular, you can notice that the guide plane 10 is made up of a supporting plane 11 equipped with a plurality of iron-guide taper bushing through-openings 13, inside which both the reinforcement irons and a plurality of connection seats 15 can be inserted, which are preferably arranged along the edges of such supporting plane 11, which are suited to allow fully constrained connection of the guide plane 10 with one or several supporting brackets 30. Obviously, the number, dimensions, shapes and arrangement geometry of such iron-guide taper bushing through-openings 13 and of such connection seats 15 may be most varied, without therefore departing from the scope of protection of this invention.

The iron-guide through-opening 13 shall preferably feature the shape of a truncated cone, as defined as elastic tabs 14 suited to confer centrality to the reinforcement iron placed inside it (regardless of the diameter of the same). Furthermore, the elastic tabs 14 guarantee full iron wrapping by the concrete (and, thus, adequate adhesion), as well as compliance with the international standards and regulations with regard to the bar-cover. Moreover, the peculiar shape of elastic tabs 14 (exactly with the shapes of the various types by oblong IPE, HE, UPN –T bars) placed into the iron-guide through-openings 13 of guide plane 10, as properly shaped to accommodate the irons themselves, will allow perfect hooking of any one diameter of oblong rod and/or of IPE, HE, UPN –T arranged vertically, and the same elastic tabs 14 will firmly keep the structural elements when the additional concrete is cast.

The use of guide plane 10 with the iron-guide taper bushing through-openings 13, during the packing phase, as well as of properly packed concrete featuring a medium-to-fine grain mix, will, when combined with appropriate reinforcement covering due to the perfect binding of the vertical and horizontal reinforcements in the iron-guide taper bushing through-openings 13 themselves, productively allow the manufactured item to feature high structural strength, fire protection (REI) and durability. Furthermore, by considering that, thanks to the guide plate 10 of the system referred to in the present invention, the vertical irons are made to run only inside the iron-guide taper bushing through-openings 13, a minimum concrete wrapping of 2.5 cm between two subsequent irons of longitudinal reinforcements will be guaranteed, regardless of the iron diameter, thus ensuring greater structural strength and REI fire protection, that is to say, thus ensuring evident, longer manufactured item durability.

In particular, as you can notice in FIGS. 3 to 5, the supporting bracket 30 is made up of one connecting portion 31, suited to make a connection with at least one panel of a transpiring, "disposable" heat-insulation formwork, connected with at least one supporting portion 33 suited to support at least one edge portion of guide plane 10.

Obviously, the connecting portion 31 may be equipped with any one connecting means, the latter being a mechanical connecting means or any one lock-in profile that will make it possible to connect the supporting bracket 30 of the dynamic construction system referred to in the present invention with the corresponding lock-in profile of any one panel known in the relevant trade, without therefore departing from the scope of protection of this invention. In particular, the connecting portion 31 includes at least one lock-in profile shaped essentially like a 'T' (35', 35", 35'") suited to be inserted into the corresponding T-shaped lock-in profiles of nearly all of the panels (even made of EPF) known in the relevant trade: the lock-in profile will, in order to facilitate the insertion thereof into the panel's lock-in profile inside, be equipped with at least one adequately flared lower portion.

The supporting portion 33 will, instead, include at least one support bracket 37', 37", 37'" suited to support at least one edge portion of guide plane 10, such bracket 37', 37", 37'" being preferably equipped with at least one connecting means, such as, for instance, al elastic pin 39', 39", 39'" suited to fit into the inside of one of the connection seats 15 of guide plane 10 and also grip, due to interference, inside the same owing to elastic expansion of elastic pin 39', 39", 39'" itself.

At least one supporting saddle 41', 41", 41'" may preferably be placed in between the connecting portion 31 and the supporting portion 33, such supporting saddle being suited to support, in a constrained fashion, one or several reinforcement irons arranged horizontally with no diameter constraints.

Moreover, the supporting bracket 30 may include one connecting means 43 used for connection with a transpiration duct (not shown) leading out of connecting portion 31 through at least one end opening 45, such transpiration duct being suited to productively allow, by placing (if necessary) one check valve (not shown) in between, transpiration from the reinforcement inside towards the outside through the panels of the transpiring, "disposable" heat-insulation formwork, due to the effect of the pressure difference that will obviously take place.

In one preferred embodiment of the supporting bracket 30 relative to the dynamic construction system referred to in the present invention, such as the one shown in the Figure, you can notice that the bracket 30 itself may be made up of a plurality of modules (for instance, bracket 30 in the Figure is made up of three modules A', A", A'") connected with one another by placing pre-established score lines T', T" in between, each of said modules A', A", A'" being made up of at least one of such lock-in profiles shaped essentially like a 'T' (35', 35", 35'"), at least one of such support brackets 37', 37", 37'" with, if necessary, at least one respective elastic pin 39', 39", 39'" and, if necessary, at least one supporting saddle 41', 41", 41'". As a result, for instance, module A' of bracket 30 is made up of 1 lock-in profile shaped essentially like a 'T' 35', as well as of the support bracket 37' with elastic pin 39' and the supporting saddle 41', whereas module A'" is made up of 1 lock-in profile shaped essentially like a 'T' 35", as well as of the support bracket 37" with elastic pin 39" and the supporting saddle 41", whereas module A'" is made up of 1 lock-in profile shaped essentially like a 'T' 35'", the support bracket 37'" with elastic pin 39'" and the supporting saddle 41'".

Obviously, though each dynamic construction modules is, by way of example, made up of only one profile, one bracket and one saddle, it can obviously be anticipated that the bracket 30 may take any other shape with different quantities of the aforesaid elements, even differing from one another according to the individual modules, without therefore departing from the scope of protection of this invention.

This feature will thus allow highly dynamic and modular installation of the construction system 1 referred to in the present invention; in fact, bracket 30 may, according to the specific structural requirements, either be used as a whole item or being divided, by being broken along the pre-established score lines T', T" to obtain a bracket 30 featuring smaller dimensions. Moreover, still in order to guarantee accurate positioning of reinforcement irons, the same lock-in profiles shaped essentially like a 'T' 35', 35", 35'" may be equipped with at least one respective removable tab 47', 47", 47'": in particular, the removable tab 47', 47", 47'" may be removed from the lock-in profile shaped essentially like a 'T' (35', 35", 35'") by being broken along a score line 49', 49", 49'" so as to change the height of positioning bracket 30 along the panel of the transpiring, "disposable" heat-insulation formwork once such lock-in profile 35', 35", 35'" has been inserted into the respective lock-in profile of the panel itself, and also allow highly accurate positioning (heightwise) of guide plane 10 in which closed and/or opened U-shaped steel structural brackets can be housed horizontally, such structural brackets featuring proper 45° bend in the end portion for perfect overlapping (not shown) and being firmly constrained by special elastic pins.

By referring to FIGS. 6 and 7 in particular, you can notice possible installation configurations for the dynamic construction system 1 referred to in the present invention, inside a formwork (not shown) made up of a plurality of guide panels 1 and supporting brackets 30.

As you can notice in FIG. 8 in particular, the dynamic construction system referred to in the present invention may also include at least one modular anchoring grid 40 suited to allow perfect pillar anchoring to the foundation.

Furthermore, as you can notice in FIGS. 9, 10 and 11 in particular, in order to guarantee stiff connection among the various guide planes 10, the dynamic construction system referred to in the present invention also includes at least one fully modular enclosing system 50 suited to enclose (on the perimeter) the pillar structure obtained by means of guide planes 10 and brackets 30. In a first preferred embodiment such as the one shown in FIG. 9, the modular enclosing system 50 includes honeycomb cross-pieces 51 equipped with threaded heads, with provisions for inner slots at each central cell for inserting at least one fastening screw that shall be screwed to the pillar of the connector fitted into the panel of the transpiring, "disposable" heat-insulation formwork, in order to ensure the strength thereof to the additional concrete cast pressure, as well as at least one angular junction element 53 suited to be snap-fitted by means of a bayonet mount and/or be screwed to said heads by means of butterfly-head screws or bolts. The modular enclosing construction system 50 also includes one dual element 55 featuring a snap-in lock and lower and upper helical toothing to adjust the pitch and measurement of the transpiring, "disposable" heat-insulation formwork and/or of a conventional one, as well as firmly constrain cross-piece 51.

According to another preferred embodiment such as the one shown in FIG. 10, the modular enclosing system 50 includes at least one modular reversible-chain constant-pitch element 57 able to be assembled to obtain any one measurement (multiples and submultiples too), with no configuration limits for the concrete separators or pillars. Furthermore, the dynamic modular chain element 57 features central drills to allow the insertion of at least one fastening screw that shall be screwed to the pillar of the connector fitted into the panel, in order to ensure the strength thereof to the additional concrete cast pressure. Obviously, the dynamic modular chain element 57 is especially intended for reinforcing pillars featuring oval, round, hexagonal and octagonal sections and separators featuring any one section, with no constraint at all on different shapes.

According to one further preferred embodiment such as the one shown in FIG. 11, the dynamic, modular enclosing system 50 includes honeycomb cross-pieces 59 equipped with heads featuring toothed snap-in locks, provisions for inner slots at each central cell for inserting at least one fastening screw that shall be screwed to the pillar of the connector fitted into the panel, in order to ensure the strength thereof to the additional concrete cast pressure, as well as at least one tightening element 61 for the heads of cross-pieces 59, such tightening element 61 featuring preferably a round shape in order to guarantee the safety, at the work place, of the operators themselves applying the item.

FIGS. 12 to 15 show perspective and side views of the dynamic modular construction system 1 and the supporting brackets 30 referred to in this invention: in particular, the supporting brackets 30 are shown as being coupled with beams 90 for perfect support of reinforcement irons, as shown clearly in FIG. 17.

The invention claimed is:

1. A dynamic modular construction system used for reinforcing foundations, pillars, isolated footings, anti-seismic separators intended for transpiring, "disposable" heat-insulation and variable-geometry formwork, said construction system including at least one guide plane of vertical elements relative to said reinforcement and at least one supporting bracket of said plane, said bracket suited to enable installation of said guide plane with respect to said transpiring, "disposable" heat-insulation formwork, said supporting bracket being made up of one connecting portion suited to make a connection with at least one panel of said transpiring, "disposable" heat-insulation formwork, said connecting portion being connected with at least one supporting portion suited to support at least one edge portion of said guide plane, said connecting portion including at least one lock-in profile shaped essentially like a 'T', said supporting portion including at least one support bracket, suited to support at least one edge portion of said guide plane, wherein said supporting bracket is made up of a plurality of modules connected with one another by placing pre-established score lines in between, each of said modules being made up of at least one of said lock-in profiles shaped essentially like a 'T', at least one of said support bracket, at least one elastic pin and at least one supporting saddle, wherein said guide plane is made up of one supporting plane equipped with a plurality of iron-guide taper bushing through-openings and a plurality of connection seats suited to allow constrained connection of said guide plane with one or several said supporting brackets.

2. The dynamic modular construction system in accordance with claim 1, wherein said bracket, is equipped with at least one elastic pin suited to fit inside one of said connection seats of said guide plane.

3. The dynamic modular construction system in accordance with claim 1, wherein at least one supporting saddle is placed in between said connecting portion and said supporting portion.

4. The dynamic modular construction system in accordance with claim 1, wherein said supporting bracket includes at least one connecting means used for connection with a transpiration duct leading out of said connecting portion through at least one end opening.

5. The dynamic modular construction system in accordance with claim 1, wherein said lock-in profile shaped essentially like a 'T' equipped with at least one removable tab along one score line.

6. The dynamic modular construction system in accordance with claim 1, further comprising at least one modular anchoring grid suited to allow anchoring of said pillars to said foundation in compliance with the international connection standards.

7. The dynamic modular construction system in accordance with claim 1, further comprising at least one modular enclosing system suited to enclose, on the perimeter, one structure of said pillar.

8. The dynamic modular construction system in accordance with claim 7, wherein said modular enclosing system includes cross-pieces equipped with threaded heads, with provisions for inner slots at each central cell for inserting at least one fastening screw, and at least one angular junction element suited to be screwed to said heads by means of butterfly-head screws or bolts.

9. The dynamic modular construction system in accordance with claim 8, wherein said modular enclosing system includes at least one dual element featuring a snap-in lock and lower and upper helical toothing.

10. The dynamic modular construction system in accordance with claim 7, wherein said modular enclosing system includes at least one modular reversible-chain constant-pitch element characterized by multiples and submultiples, said modular chain element featuring central drills to make it possible to insert at least one fastening screw.

11. The dynamic modular construction system in accordance with claim 7, wherein said unique modular enclosing system includes cross-pieces equipped with a head featuring toothed snap-in locks, with provisions for inner slots at each central cell for inserting one fastening screw, and at least one tightening element of said heads of said cross-pieces.

12. The dynamic modular construction system in accordance with claim 1, wherein the dynamic modular construction system enables assembling of a plurality of connectors, plates, structural bracket elements and insulating panels, in order to make four reinforced pieces of falsework made up of said structural brackets and oblong elements, directly at the site.

13. The dynamic modular construction system in accordance with claim 1, wherein the dynamic modular construction system constrains all of the reinforcement bars, both longitudinally and vertically, with a minimum concrete wrapping of 2.5 cm between two subsequent irons of longitudinal reinforcements.

14. The dynamic modular construction system in accordance with claim 1, wherein the dynamic modular construction system constrains a plurality of U-shaped structural brackets with a portion bent by at least 45°.

* * * * *